United States Patent [19]

Blanchard et al.

[11] 4,442,324

[45] Apr. 10, 1984

[54] ENCAPSULATED BACKPLATE FOR ELECTRET TRANSDUCERS

[75] Inventors: Senior N. Blanchard, Spruce Head; William T. Flint, Owls Head; George C. Tibbetts; Joseph A. Sawyer, both of Camden, all of Me.

[73] Assignee: Tibbetts Industries, Inc., Camden, Me.

[21] Appl. No.: 391,966

[22] Filed: Jun. 24, 1982

[51] Int. Cl.[3] ..... H04R 19/00

[52] U.S. Cl. ..... 179/111 E

[58] Field of Search ..... 307/400; 179/111 E; 29/592 E

[56] References Cited

U.S. PATENT DOCUMENTS

| | | | |
|---|---|---|---|
| 3,772,133 | 11/1973 | Schmitt | 307/400 |
| 3,967,027 | 6/1976 | Igarashi et al. | 307/400 |
| 4,014,091 | 3/1977 | Kochero et al. | 179/111 E |
| 4,302,633 | 11/1981 | Tamamura et al. | 179/111 E |

*Primary Examiner*—A. D. Pellinen
*Assistant Examiner*—Danita R. Byrd
*Attorney, Agent, or Firm*—Kenway & Jenney

[57] ABSTRACT

Electrically conductive sheets comprising backplates for electret transducers are substantially encapsulated with hydrophobic electrically insulating coatings. The coatings are melt bonded to both faces of the sheets and to the edges of the sheet periphery. Likewise, the coatings are melt bonded to the interior edges of acoustic apertures in the sheets.

9 Claims, 6 Drawing Figures

ENCAPSULATED BACKPLATE FOR ELECTRET TRANSDUCERS

SUMMARY OF THE INVENTION

This invention relates generally to electret transducers and to methods of manufacture of the backplate assemblies employed in such transducers. More particularly, the invention relates to electret transducers of the type in which an electrically conductive backplate supports on its face a substantially fixed electret film.

As is well known, the moving element of such a transducer is an electrically conductive non-electret diaphragm which is located facing the electret film and vibrates relative thereto. The capacitive transducer comprising the backplate and diaphragm is polarized and made operative by the charged electret film.

In prior art transducers of this type, it is common for the electret film to cover only, or substantially only, the major surface of the backplate that faces the diaphragm. With these transducers a number of problems have been observed, including a lack of uniformity and predictability in the initial charging, a lack of desirable charge stability under subsequent processing in manufacture after charging, and after aging, and limitations on the retention of electret charge under severe environmental conditions during which moisture condenses on the internal parts of the transducer. The principal object of this invention is to overcome the above and other related problems.

With this and other objects hereinafter appearing in view, a principal feature of this invention is a substantially encapsulated backplate, that is, a backplate having its surfaces substantially completely covered and protected from contact with moisture, typically liquid water condensate, by an electrically insulating coating of material resistant to wetting thereby, and substantially completely covering and bonded to such surfaces. It has been found that such encapsulation results in improved electret charge stability. Morever, the coating employed may comprise the material that functions as the charged electret film, or alternatively, it may comprise a composite of such film and other material that is suitably hydrophobic in addition to providing other desirable properties such as heat resistance or adhesive bonding capability.

Processes for the encapsulation of the backplates have also been provided. In general, these involve the placing of films of the electret material, or composites of such material and other materials, over the principal surfaces of the backplate and melt bonding of the films to such surfaces. These steps may be accomplished in any of several ways, which in any case provide for the fusion of the films overlying the opposite faces of the backplate so as to cover its peripheral edge and the interior edge of each acoustic perforation typically formed in the backplate.

Other features of the invention will be appreciated from the following description of the presently preferred embodiments and methods of producing them.

DRAWING

DETAILED DESCRIPTION

Figure 1:
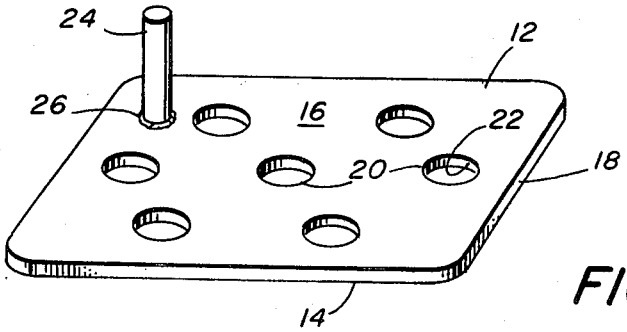
FIG. 1 is a view in perspective of the electrically conductive portion of a backplate with the coating material not shown.

FIG. 1 illustrates a typical electrically conductive sheet 12 which may be fabricated from a suitable metallic alloy. As illustrated, the sheet has a front face 14, a back face 16, a continuous peripheral edge 18, a plurality of acoustic apertures 20 having interior edges such as 22, and an attached electrically conductive tab 24. When assembled into a complete electret transducer according to conventional practice, the front face 14 is located in facing relationship to the diaphragm of the transducer (not illustrated). The tab 24, shown as a wire segment, is welded to the back face, for example by a percussion weld 26. In operation of the transducer, the tab 24 provides an electrical connection to the electrically conductive sheet 12. It should be observed that the tab is illustrated in its relationship to the sheet 12 after all steps of fabrication have been completed; whereas, according to the methods hereinafter described, it is not attached to the sheet until after preliminary steps in the process of encapsulation.

It will be further observed that the backplate may be formed in other than substantially flat configurations, in accordance with techniques known to those skilled in the art, with the employment of a suitable method of encapsulation hereinafter described.

Figure 2:
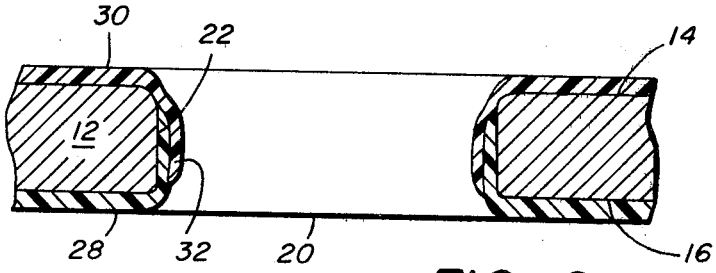
FIG. 2 is a fragmental elevation in section showing the cross section of an acoustic aperture in the embodiment of FIG. 1, illustrating the conditions at an intermediate stage according to a first method of encapsulation.

FIG. 2 illustrates a first method of encapsulation, showing the conditions at an intermediate stage thereof. Initially, the sheet 12 is provided in the form shown in FIG. 1, but without the attached tab 24. A piece of polymeric film 28 is placed against the back face 16 so as to overlie the entire surface of such face and all of the apertures 20. The film 28 may comprise any of the useful electret materials, typified by a copolymer of tetrafluoroethylene and hexafluoropropylene. This material has a very low surface energy such that it is wet only with difficulty by liquid water and at very high contact angles. The desirable hydrophobic and electret properties of the material are retained after heating above the fusion temperature in subsequent steps of fabrication. Next, the film 28 is coated onto the back face 16 in a conventional vacuum thermoforming operation, during which the film is partially bonded to the back face 16 and a substantial portion of the interior edge 22 of the aperture 20. The temperature during this operation is such that the film usually bursts at each aperture so that it is not plugged. In cases where the film does not so burst at an aperture, it may be pierced subsequently. Alternatively, the excess film material at each aperture may be lost onto a screen that supports the sheet 12 on its front face 14 during the vacuum thermoforming operation. The peripheral edge 18 has a substantial portion similarly covered by the film 28.

After the coating of the film 28 upon the back face 16, the film may be pierced at the location chosen for attachment of the tab 24. The tab is then attached to the sheet 12 by percussion welding.

The tab 24 may then be used to support the backplate in a second vacuum thermoforming operation. In this operation, a film 30 is placed over the front face of the sheet 12, and then partially bonded thereto under heat and vacuum so that the film 30 overlaps the film 28 at the interior edge 22 of each aperture, and similarly at the peripheral edge 18 of the sheet 12.

After the coating of the sheet 12 by the films 28 and 30 in the above manner, the backplate assembly so formed is preferably heated to a higher temperature than that employed during the thermoforming operations, sufficient to complete the melt bonding of the films to the surfaces of the sheet 12, and to fuse the films 28 and 30 together at their regions of overlap, as at 32. After completion of this step, the backplate is substantially encapsulated with electret film and is ready for charging of the film 30.

Figure 3:
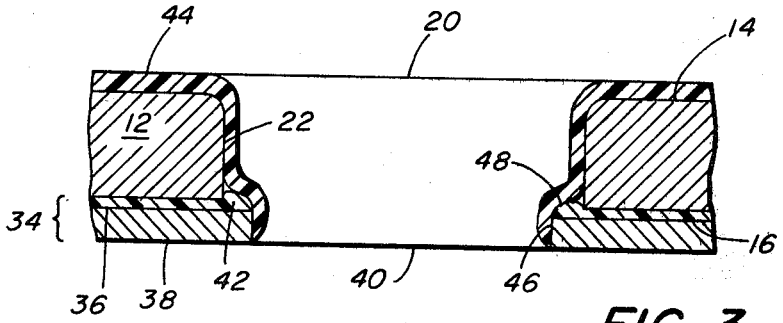
FIG. 3 is a fragmental elevation in section similar to that of FIG. 2, but illustrating the condition at an intermediate stage in a second method of encapsulation.

A second method of encapsulation, is illustrated as partially completed in FIG. 3. This method is particularly suitable for substantially flat backplates and is characterized by having only a single vacuum thermoforming operation. In place of providing the film 28 of FIG. 2, a film laminate 34 is provided. This laminate comprises a polymer layer 36 which may be identical or similar to the electret material of the films 28 and 30, or compatible therewith, and a second layer 38 of electrically insulating material. The second layer 38 may comprise a material which, as compared to the material of the first layer, is more heat resistant, or more readily bondable with conventional adhesive techniques. The layer 38 may comprise, for example, polytetrafluoroethylene or a polyimide. The layers 36 and 38 may be provided as discrete films prior to the operations described below, or they may be provided in the form of a composite film such as the film produced by du Pont and marketed under the trademark "Kapton F." A preliminary step according to this method of encapsulation is to blank the film laminate 34 to provide apertures such as 40 that are smaller than the corresponding apertures 20 in the sheet 12; and likewise, the film laminate is blanked to have an external periphery that is larger than the corresponding periphery 18 of the sheet 12. Preferably, the piece of film laminate is also prepunched with a suitable aperture through which the tab 24 may be subsequently welded to the sheet 12 as hereinafter described.

In the first step of encapsulation according to the method of FIG. 3, the film laminate 34 is placed against the back face 16 of the sheet 12, and is melt bonded to the sheet in a hot pressing operation. If the layers 36 and 38 are provided as discrete films, bonding also occurs between these layers during the hot pressing operation. Also during the hot pressing operation, the material of the film layer 36 extrudes to form a bead 42.

Next, the tab 24 is attached to the sheet 12 through the aperture previously formed.

Next, a film 44 of electret material similar to the films 28 and 30 of FIG. 2 is vacuum thermoformed to coat the front face 14 of the sheet 12 and the major part of the interior edge 22 of the apertures 20 as well as the peripheral edge 18. As shown, the film 44 extends to cover the bead 42 and at least a portion of the edge 46 of the film layer 38.

After completion of the vacuum thermoforming operation, the assembly is heated to a temperature sufficient to complete the melt bonding of the film 44 to the surfaces of the sheet 12 and to fuse together the film 44 and bead 42, which are in contact at 48.

A backplate formed according to the method of FIG. 3 may have additional advantages imparted by the properties of the film layer 38. Thus if this layer is heat resistant, it is non-sticking at high temperatures and may be used if desired to support the assembly during the vacuum thermoforming of the film 44. Depending on the choice of material, in some instances the outer surface of the film layer 38 may also be readily bondable by conventional adhesive techniques to adjacent structures in the transducer.

Figure 4:
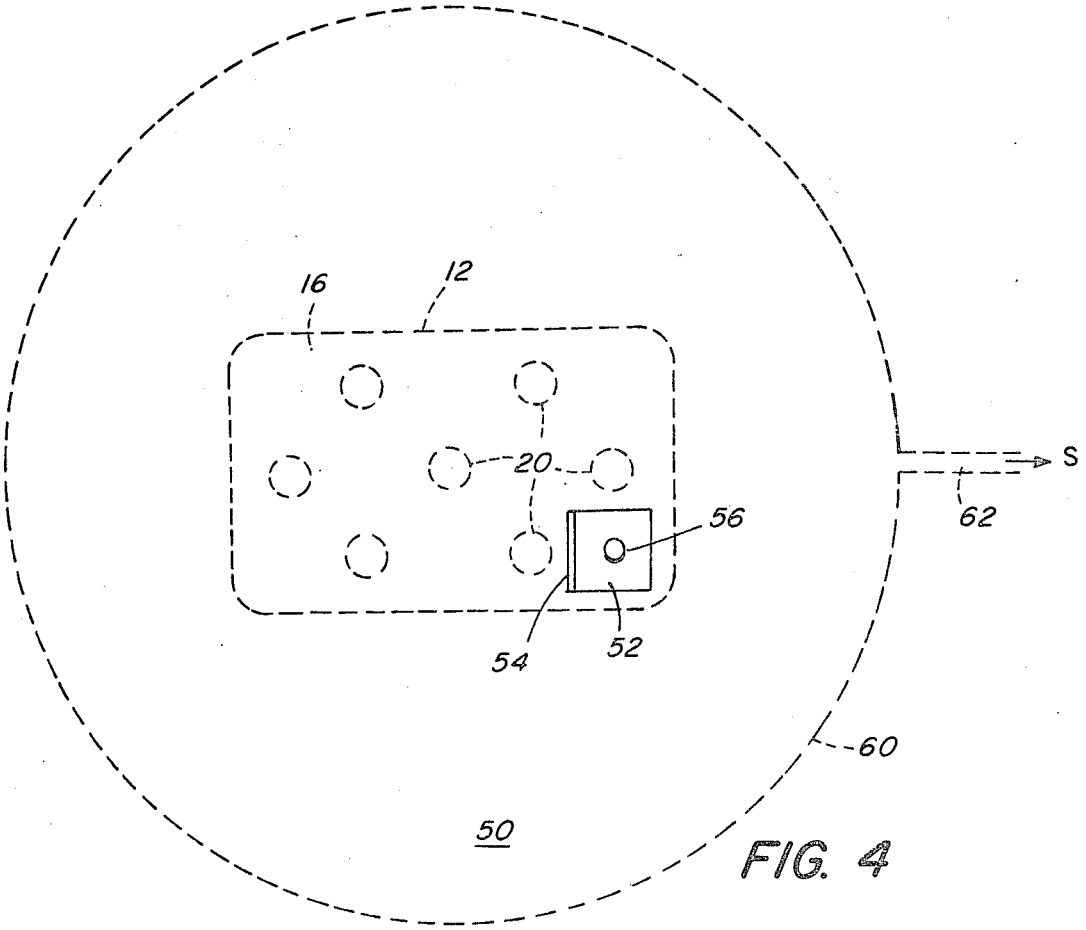
FIG. 4 is a plan view illustrating a third method of encapsulation.
Figure 5:
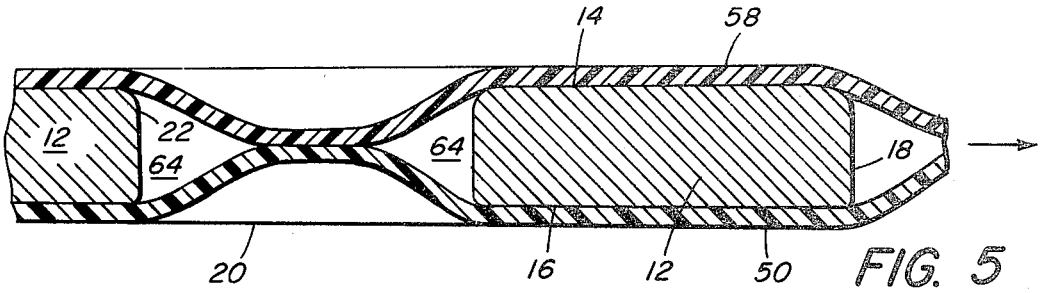
FIG. 5 is a fragmental elevation in section similar to FIGS. 2 and 3, but illustrating the conditions at an intermediate step in the encapsulation method of FIG. 4.
Figure 6:
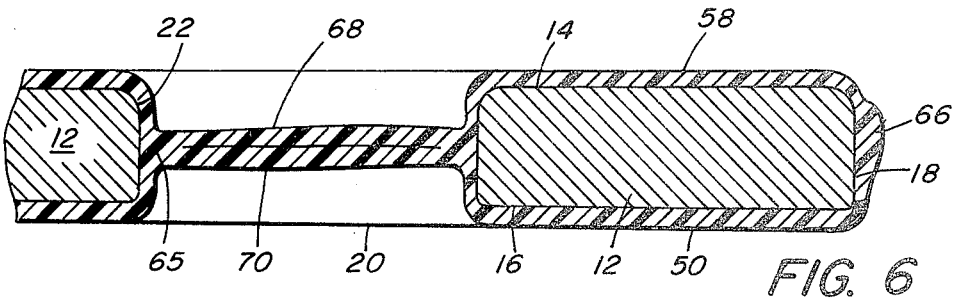
FIG. 6 illustrates the conditions of the embodiment of FIG. 5 after a further step in the encapsulation method of FIG. 4.

FIGS. 4, 5 and 6 illustrate a third method of encapsulation, which has the important advantage of providing protection against oxidation of the sheet 12 during the high temperature exposure necessary for the fusion coating of its surfaces. According to this method, a polymer film 50 is placed over the back face 16 of the sheet 12, and an L-shaped tab 52 is weld bonded through the film 50 to the sheet 12. The tab 52 is preferably formed of thin strip material to have an upright portion 54 that extends away from the backplate, and also to have a pierced sharp protrusion 56. In this case resistance welding is employed, and welding electrodes apply pressure on the tab 52 and face 14 of the sheet 12, this pressure causing the protrusion 56 to pierce the film 50, thereby providing the initial electrical contact for the welding operation.

After the tab 52 has been welded to the sheet 12, the polymer film 50 is squeezed locally between the tab and the face of the sheet 12, being thereby partially fused to the tab and back face to provide a gas-tight seal around the weld nugget. Another sheet 58 of polymer film is then assembled adjacent the face 14 of the sheet 12. Sealing means schematically illustrated at 60, for example an O-ring, are interposed between the two sheets 50 and 58. A vacuum conduit 62, for example a hypodermic needle inserted radially through the O-ring, is provided and connected with a suitable vacuum pump (not illustrated). Electrically insulating rings (not shown) are provided at the outer faces of the respective polymer films, so as to bear upon them and squeeze them against the O-ring or other sealing means to complete the seal of the system.

Vacuum is then applied between the films, which collapse upon each other and upon the sheet 12, as illustrated in FIG. 5. It is essential that the vacuum be maintained long enough to obtain substantially complete evacuation of the void spaces such as 64. If desired, the back face 16 can be roughened, or alternatively coined with a suitable pattern of indented channels connecting the apertures 20 with the peripheral edge 18, to accelerate the pump down of the spaces 64. As a further measure to obtain the desired evacuation of such spaces, the sheet 12 may be prepared for the process of encapsulation by being subjected to an outgassing operation in a vacuum oven.

After sufficient evacuation has taken place, the assembly may be supported by the portion 54 of the tab 52 while being subjected to heat sufficient to complete the fusion bonding of the films 50 and 58 to the sheet 12 and to one another at the peripheral edge 18 and interior edges 22. Preferably, this heating is accomplished by RF induction using coils that supply an oscillatory magnetic field substantially normal to the plane of FIG. 4. When this heating method is employed, the rings that clamp the films 50 and 58 to the sealing means 60 are of electrically insulating material.

It is noted that during the high temperature exposure in this method, the films 50 and 58 protect the sheet 12 against oxidation. This permits greater latitude in selecting the appropriate temperature for proper fusion of the films. Such temperature is controlled in any case with consideration for the gravitational, surface tension and eddy current forces to which the films are subjected. Accordingly it is possible to heat the periphery of the sheet 12 to temperatures at which the polymer has relatively low viscosity. At such temperatures the films will have collapsed onto the peripheral edge 18 and become melt bonded to it, as well as to each other in the vicinity of the peripheral edge. A similar pattern of flow may occur in an aperture 20, depending on its location on the sheet 12. If the temperature of the latter is high enough at a particular aperture 20, similar collapse, melt bonding and fusion of the films, (as at 65 in FIG. 6) will occur. At cooler regions that may exist by virtue of the inhomogenious heating method employed, the films may simply collapse further, or an intermediate result may take place. Thus voids corresponding to spaces such as 64 in FIG. 5 may remain temporarily, but will still be evacuated since the vacuum seal has not been broken.

While the assembly is at or near its maximum temperature during the preceding step, the sheet 12 may be lifted by means of the portion 54 of the tab, out of the general plane of the polymer films 50 and 58. This movement will melt out the encapsulated backplate from the surrounding portions of the films 50 and 58, by severance therefrom at or near the periphery 18. If such withdrawal of the backplate from the surrounding films is not done too rapidly, a bead 66 will be formed as shown in FIG. 6 without undue stringing or accumulation of the polymer material.

After the melt out operation just described, the backplate may be heated by any suitable means to complete the melt bonding of the films to all of the surfaces of the sheet 12, including the interior edges 22, substantially collapsing any voids remaining from spaces previously existing as at 64 (FIG. 5). This operation is preferably performed soon after the melt out, so that diffusion of gases such as oxygen through the film does not appreciably raise the residual gas pressure in the voids or spaces such as 64. During this reheat, the bead 66 will reflow somewhat to become more nearly symmetrical.

Thereafter, or in conjunction with the reheat, film portions as at 68 and 70 may remain in the apertures 20. These may be blanked out, mechanically pierced, or punctured with hot gas jets. If necessary, the backplate may be again reheated, to cause the desired flow of the remaining polymer film material within the apertures 20 into beads on the interior edges 22 thereof, similar to the reflowed bead 66.

Backplates encapsulated by the foregoing methods, or other known methods producing similar results, make it possible to provide electret transducers that have a more uniform and predictable initial charging, and which have greater charge stability under subsequent processing and aging. Such transducers have superior retention of electret charge under extremely severe environmental conditions including conditions in which moisture condenses on the internal parts of the transducer. The low surface energy of the coating films provides superior wet stability of the structure which is due to the fact that the surfaces are wet only with difficulty by liquid water and at very high contact angles. In particular, moisture condensed on the coated back face cannot initially form a continuous film and is impeded from creeping along that surface, through the acoustic apertures and into the working gap between the charged electret and the diaphragm.

It will be recognized that structures characteristic of this invention can be formed by other methods including so-called powder coating in which polymer powder is partially fused onto a heated backplate immersed in a bed of powder fluidized by a gas stream. However, the methods hereinabove described, utilizing discrete polymer films, are presently preferred.

We claim:

1. A backplate assembly for an electret transducer comprising, in combination, an electrically conductive sheet having a peripheral edge, front and back faces with an electrically conductive tab extending from said back face, and at least one acoustic aperture communicating between said faces, and an electrically insulating coating of material substantially covering and bonded to both of said faces, said peripheral edge and the interior edge of each said aperture, said coating including a layer of electret material covering said front face.

2. A backplate assembly according to claim 1, in which the coating has a uniformly low surface energy causing said surface to be resistant to wetting by liquid water.

3. A backplate assembly according to claim 2, in which said surface energy does not substantially exceed that of said electret material.

4. A backplate assembly according to claim 1, in which the coating is bonded to said back face about the tab and the tab extends through the coating.

5. A backplate assembly according to claim 1, in which the coating comprises front and back sheets of polymeric material respectively covering said front and back faces and bonded to one another at said peripheral and interior edges.

6. A backplate assembly according to claim 5, in which the front and back sheets overlap one another at said peripheral and interior edges.

7. A backplate assembly according to claim 5, in which the back sheet is a laminate comprising a first layer of material compatible with the electret material covering said front face and heat fused to said back face, and a second layer of electrically insulating material over the first layer.

8. A backplate assembly according to claim 5, in which the second layer comprises a material that is bondable by means of adhesive.

9. A backplate assembly according to claim 5, in which the second layer comprises a material that is more heat resistant than the material of the first layer.

* * * * *